US006148490A

United States Patent [19]

Bertsch

[11] Patent Number: 6,148,490

[45] Date of Patent: Nov. 21, 2000

[54] PROCESS AND DEVICE FOR TEXTURING AT LEAST ONE ENDLESS FILAMENT YARN

[75] Inventor: Gotthilf Bertsch, Ebnat-Kappel, Switzerland

[73] Assignee: Heberlein Fibertechnology, Inc., Wattwill, Switzerland

[21] Appl. No.: 09/043,434

[22] PCT Filed: Sep. 11, 1996

[86] PCT No.: PCT/CH96/00311

§ 371 Date: Oct. 14, 1998

§ 102(e) Date: Oct. 14, 1998

[87] PCT Pub. No.: WO97/11214

PCT Pub. Date: Mar. 27, 1997

[30] Foreign Application Priority Data

Sep. 20, 1995 [CH] Switzerland ..... 2655/95

[51] Int. Cl.[7] ..... D02G 1/16

[52] U.S. Cl. ..... 28/272; 28/254

[58] Field of Search ..... 28/254, 271, 272, 28/273, 274, 276; 57/279, 908, 350, 333

[56] References Cited

U.S. PATENT DOCUMENTS

| | | | |
|---|---|---|---|
| 3,835,510 | 9/1974 | Koslowski . | |
| 3,881,231 | 5/1975 | Price et al. | 28/254 |
| 4,507,833 | 4/1985 | Simmen | 28/254 |
| 4,547,938 | 10/1985 | Cullen et al. | 28/254 |
| 4,641,504 | 2/1987 | Runkel et al. | 28/272 |
| 4,936,000 | 6/1990 | Nabulon et al. | 28/272 |
| 4,953,271 | 9/1990 | Wellenhofer et al. | 28/272 |
| 5,140,729 | 8/1992 | Simmen | 28/254 |
| 5,241,730 | 9/1993 | Simmen et al. | 28/254 |
| 5,475,908 | 12/1995 | Scherpf et al. | 28/272 |
| 5,475,909 | 12/1995 | Heil et al. | 28/272 |
| 5,511,295 | 4/1996 | Shah | 28/254 |
| 5,575,049 | 11/1996 | Gorrafa et al. | 28/272 |

FOREIGN PATENT DOCUMENTS

| | | |
|---|---|---|
| 0 088 254A2 | 9/1983 | European Pat. Off. . |
| 110359 | 6/1984 | European Pat. Off. . |
| 0 625 600A1 | 11/1994 | European Pat. Off. . |
| 0 625 600B1 | 11/1994 | European Pat. Off. . |
| 626473 | 11/1994 | European Pat. Off. . |
| 3901020 | 7/1989 | Germany . |

OTHER PUBLICATIONS

G. Bock et al., "The Intermingling Action During Air–Jet Texturing", Textil Praxis International, 39:551–558 (1984).

*Primary Examiner*—Amy B. Vanatta
*Attorney, Agent, or Firm*—Finnegan, Henderson, Farabow, Garrett & Dunner

[57] ABSTRACT

A texturizing device for yarn texturing includes a yarn channel having movable components for rapidly releasing the entire yarn path. The nozzle body of the texturizing device preferably includes two parts as a glide plate and a sliding nozzle plate, in which the yarn channel is arranged in a U-shape in the slide plate and moved in relation to a flat glide plate via an articulated lever. Depending on the position of the articulated lever, the entire yarn path is fully open for threading or closed for texturing operation. A deflector may also be provided and can either be connected to moving parts or non-moving parts of the device. An air supply may be coupled with the sliding nozzle plate such that the air supply is blocked in the threading position of the articulating lever and open in the operating position of the articulating lever.

17 Claims, 7 Drawing Sheets

PROCESS AND DEVICE FOR TEXTURING AT LEAST ONE ENDLESS FILAMENT YARN

TECHNICAL FIELD

The invention relates to a process and apparatus for texturing at least one continuous filament yarn consisting of a yarn duct with compressed air supply and a texturing chamber limited by a deflecting member for a take-off of the textured yarn substantially at right angles to the yarn duct.

STATE OF THE ART

The theoretical principles of air jet texturing are described in the specialist article: Bock/Lüinenschloss, Textilpraxis International, June 1984. Two design concepts can now be distinguished in practice: one with an internal texturing chamber and the other with an external texturing chamber. FIG. 1 of the patent specification shows schematically, with reference to the specialist article, the main functions of the texturing process with an external texturing zone which is not constructionally limited in the direction of flow. EF denotes the continuous filament as unimproved filament yarn Groh and Gtex as textured yarn. The continuous filament EF is grasped by the air stream, opened and delivered with excess directly into the texturing zone T. The texturing zone is the actual processing zone in which texturing takes place. The textured yarn Gtex is taken off substantially at right angles (thin arrow) from a braiding point F. The direction of the air stream is symbolized by thick arrows. FIG. 2 shows a cross section through a texturing nozzle from the prior art with external texturing chamber. GW designates the yarn path. It has been found in practice that it is important to provide a deflecting member P to limit the texturing chamber T with respect to texturing quality. Almost without exception, all texturing apparatuses nowadays employ deflecting members. The main advantage resides in exact restriction or definition of the texturing chamber T, so the texturing conditions can be reproduced to a great extent. In FIG. 2, the deflecting member is in the form of a roller and is arranged at a distance A after the yarn duct. The textured yarn is guided round the deflecting member. FIGS. 2*a* and 2*b* show two correspondingly known texturing nozzles produced by the applicants with external texturing chamber. In FIG. 2*a*, the threading position Epos (P') is shown in dot-dash lines in addition to the operating position Bpos according to FIG. 2. For drawing in the yarn, the deflecting member is pivoted in the form of an arc from the yarn duct so the yarn path in the region of the texturing chamber is free for the threading process, for example with a threading gun. FIGS. 3 and 3*a* show a further known design of a texturing apparatus, for example according to EPA No. 88 254. FIG. 3 is the threading position (Epos) and FIG. 3*a* the operating position (Bpos). Significant differences from FIG. 2 can be seen in FIG. 3. The air is supplied LA via apertures which are arranged at an angle and open directly into the yarn duct. The last portion of the yarn duct is widened in the form of a trumpet and the deflecting member P penetrates partially into the trumpet form (FIG. 3*a*) and forms an internal texturing chamber T. As in the solution according to FIG. 2, the deflecting member in FIG. 3*a* also blocks the free escape of the air from the nozzle and represents an obstruction for the threading process in the yarn path. As shown in FIG. 3, the deflecting member is pivoted away for the threading position (P'), so the yarn path is no longer obstructed for threading. The quality of the textured yarn can be monitored by a quality sensor Qs and electronic evaluator el.A. The actual texturing nozzle is fixed in a nozzle head DK, like the air connection LA. The compressed air is introduced at a pressure higher than 3 bar, preferably higher than 4 bar, for the texturing process and the air jet is driven in the direction of the widened nozzle orifice. An ultrasonic stream which effects texturing is adjusted owing to the high pressure at the first cross-sectional widening of the nozzle, even with the trumpet shape. The term "texturing" is interpreted in accordance with the currently accepted specialist opinion as the finishing process for a multifilament yarn during which shock waves or compacting shocks act as a result of the ultrasonic stream. The air stream in the ultrasonic range results in an extremely high quality of shaping and nozzle surface working. In order to withstand the stress due to the friction of the yarn for as long as possible, the nozzle members are preferably produced from wear resistant ceramic or hard alloy. The textured quality of a yarn treated by a texturing nozzle according to the two aforementioned designs is acknowledged to be very good. However, the main drawback resides in the fact that operation is more difficult, for example than with simpler whirling nozzles. The particular constitution and the form of the texturing nozzle member and accuracy of production demand high production costs.

U.S. Pat. No. 3,835,510 shows a texturing nozzle with external texturing chamber, as illustrated in FIG. 2, but with a flat deflecting member or a deflecting plate. It adjusts itself into an equilibrium position during operation by means of a lateral hinge. The same conditions as in the aforementioned texturing nozzles exist here for threading.

STATEMENT OF THE INVENTION

It is accordingly the object of the invention to find a solution which allows economic production of a texturing nozzle and, in particular, optimum handling in practice, both for threading and for operation.

The process according to the invention for yarn guidance during the texturing of at least one filament yarn, during which the yarn is guided through a yarn duct with a compressed air supply and then a texturing chamber limited by a deflecting member and is taken off from the texturing chamber transversely to the yarn duct, is characterized in that the entire yarn path is cleared in the region of the texturing chamber and the yarn duct for the threading and is closed again for texturing so a travelling and a stationary yarn can be threaded. According to a particularly preferred embodiment of the process, the yarn is deflected immediately after transverse take-off from the texturing chamber back into the direction of travel of the yarn of the yarn supply to the yarn duct. According to a further advantageous embodiment of the process, the deflecting member itself is designed as a yarn guide such that the textured yarn is at least substantially straightened again via the deflecting member, as during the supply of the yarn to texturing. According to the new process, one or more filament yarns are guided in the direction of travel of the thread and over the entire yarn path during texturing, wherein a) the entire yarn path consisting of a yarn duct and subsequent texturing chamber limited by a deflecting member, is cleared in an open threading position for threading of a travelling or stationary yarn and b) the yarn path is brought into a closed operating position for texturing, wherein c) the filament yarn is guided through the yarn duct during texturing and is then taken off from the texturing chamber substantially at right angles or transversely with respect to the yarn duct.

The apparatus according to the invention is characterized in that it is adjustable into a closed operating position and an open threading position, the yarn duct being limited by elements which are movable relative to one another and designed for rapid clearing or closure of the entire yarn path.

The main idea of the novel invention moves away from former texturing practice during which only the obstruction, namely the deflecting member, was moved away from the outlet opening of the yarn duct for the threading position. The prior art allows for the fact that threading possibly has to be carried out with aids. On the other hand, the novel invention proposes the rapid clearing of the entire yarn path, so the travelling yarn can also be threaded. The novel invention allows a significant number of particularly advantageous designs. A first very advantageous design is characterized in that the yarn duct and the texturing chamber are limited by coordinated movable elements and are designed for the rapid clearing or closure of the entire yarn path.

As will be described in detail hereinafter, there are three concepts for clearing the entire yarn path. These are:

- by concurrent movement of the deflecting member with the movable elements of the yarn duct;
- by liberation of the texturing chamber by the movement, for example of the nozzle plate;
- by a special arrangement or installation of the deflecting member so the entire yarn path is free for threading in the threading position.
- each of these concepts can also be combined with air supply control.

It is very helpful if the movable elements are combined with a compressed air valve, so the air supply is blocked in the threading position and the air supply is open in the operating position. User friendliness of a type not possible hitherto in the art of texturing is achieved by coordinating the "switching operation" of the two path functions, the yarn travel and the air path. Therefore, all switching functions can be reset rapidly in a clip-like manner at the texturing nozzle with the novel invention.

Accordingly, a movable element for the yarn duct is designed as a sliding plate which is displaceable via a preferably tilting articulated lever into the operating position and into the threading position. According to a further design, the yarn duct is formed completely in a movable nozzle plate which is displaceable relative to a plane gliding plate which limits the yarn duct over the entire length in the operating position, the yarn duct preferably having a substantially U-shaped constant or widened cross section in the region of the air stream. The nozzle outlet region can therefore have any widened form according to the particular requirement.

These solutions allow the production costs for the yarn duct to be kept very low since the yarn duct can be produced with simply guided tools in the most awkward region, namely the region of the air stream. Earlier experiments have shown that it is sufficient for many applications if the edges of a yarn duct of constant cross section are only interrupted to a minimum at both the inlet side and the outlet side so the yarn can be drawn in without damage and can be taken off at the outlet. It is advantageous for most applications if the nozzle plate is produced from a good quality ceramic. It is also proposed for the simplest texturing nozzles that the nozzle plate have one, two or more apertures for the supply of compressed air which are arranged at an angle to the yarn duct and open into the yarn duct. For higher qualities of texturing, it would be quite conceivable to arrange three apertures for the supply of compressed air at respective angles of 120°, for example according to EP-PA No. 625 600. However, this necessitates a further compressed air connection for the moving side.

If the yarn duct has a substantially U-shaped, V-shaped or semicircular, constant and/or widened cross section, at least in the region of the air stream, the yarn duct can be provided or ground completely in the nozzle plate. For this purpose, the gliding plate is provided with a closed plane gliding plane which closes the U or V on the open side of the V or U and vacates it completely for threading.

The deflecting member can be connected directly to the movable elements of the yarn duct and vacates and leaves free the yarn path in the open position. The sliding plate and the deflecting member can be moved as a movable unit via a common articulated lever. In a simple design, the deflecting member is connected directly and rigidly or in an articulated manner to the articulated lever and is pivotal transversely to the yarn duct for adjusting the closed operating position and the open threading position. This allows the production of a particularly inexpensive apparatus which is characterized in that it has a displaceable nozzle plate with a yarn duct arranged therein with a compressed air supply opening at an angle in the yarn duct, moreover a gliding plate for closure of the yarn duct and a deflecting member and a shut-off valve which are designed as a movable unit for the simultaneous rapid clearing of the entire yarn path and for the blocking or opening of the air supply. In the corresponding concrete design, the movable unit has an articulated lever on which the nozzle plate is articulated and via which the deflecting member is also movable within seconds into the operating or insertion position by a tilting movement, the air also being shut of f or released in a coordinated manner via the movement of the nozzle plate.

Texturing nozzles according to FIG. 2 could be inexpensively "modified" with the novel invention insofar as the movability of the deflecting member is concerned. On the other hand, the design of the air supply in FIG. 2 complicates the formation of two displaceable halves of the nozzle member. Conversely, with the solution having an internal texturing chamber according to FIG. 3, the deflecting member penetrating into the widened yarn duct for the operating position prevents direct displacement of one half of the yarn duct. With the texturing concept with which the deflecting member penetrates into the yarn duct during operation, an exit movement of the deflecting member from the yarn duct which is also coordinated is proposed according to the invention. The yarn duct is widened in the manner of a funnel or trumpet, the deflecting member easily penetrating into the widening in the operating position. For a change of position, the deflecting member is additionally moved at least by the depth of penetration in the direction of the yarn duct axis "X". This involves a few millimeters. The deflecting member therefore receives two portions of movement, a short penetration portion in the X axis and a path travel portion directed transversely thereto, wherein the path travel portion can be coupled directly to the movable element for the yarn duct.

As mentioned above, the deflecting member can be connected to stationary parts of the apparatus in such a way that the region of the texturing chamber is cleared for threading in the threading position. This solution is particularly suitable not only for the texturing nozzle design with external texturing chamber. In this arrangement, the deflecting member is arranged at a distance from the yarn duct for operation. The texturing chamber is limited by one end face of the nozzle plate and of the preferably flat deflecting member arranged parallel to the end face and is open at least on two sides, in particular forwardly and in the direction of travel of the yarn. The texturing chamber can therefore also be defined here in the respectively desired manner by the aforementioned elements. The deflecting member is designed for taking off the yarn from the yarn supply duct substantially at right angles and has a deflecting or guide groove open on one side. The sliding plate and the deflecting member can be designed movably as a movable unit with a common articulated lever. According to a particularly simple design, the deflecting member is designed optionally exchangeably as a plane plate, is rigidly connected to the articulated lever and is displaceable transversely to the yarn duct. According to a preferred design, the deflecting member has a plane deflecting face for taking off the textured yarn substantially at right angles and then, in the direction of travel of the yarn, a deflecting groove for determining the take-off direction for texturing, regardless of the direction of subsequent yarn travel.

The moving nozzle plate and a valve member fastened on stationary parts of the apparatus are advantageously designed as a coordinated actuable shut-off valve. This allows closure of one duct and simultaneous opening of the other duct to be carried out in a single movement with minimum expenditure. This is important during start up and also when individual yarns have to be threaded during running of the machine.

The proposed features allow the combination of practical advantages not possible in the texturing prior art:

- clear position of the texturing nozzle for threading or operation, including the air supply;
- user friendliness, threading of the yarn taking place rapidly and much more simply, without aids;
- the production costs for the individual elements are economical;
- as demonstrated by experiments, a quality of texturing quite equivalent to the former quality with more expensive nozzles can be achieved with simpler texturing nozzles at least in some spheres of application.

BRIEF DESCRIPTION OF THE INVENTION, STARTING FROM THE STATE OF THE ART

The prior art and the novel invention will now be described in further derail with reference to embodiments.

Figure 1:
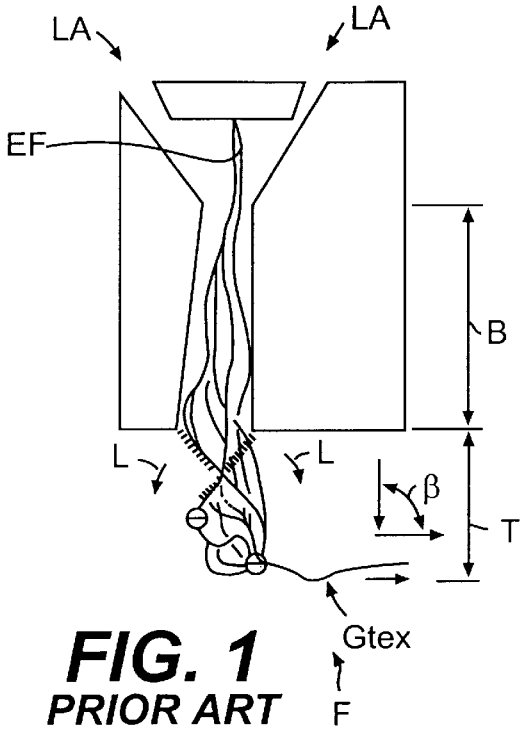
FIG. 1 PRIOR ART
FIG. 1 shows the known texturing process schematically.
Figure 2:
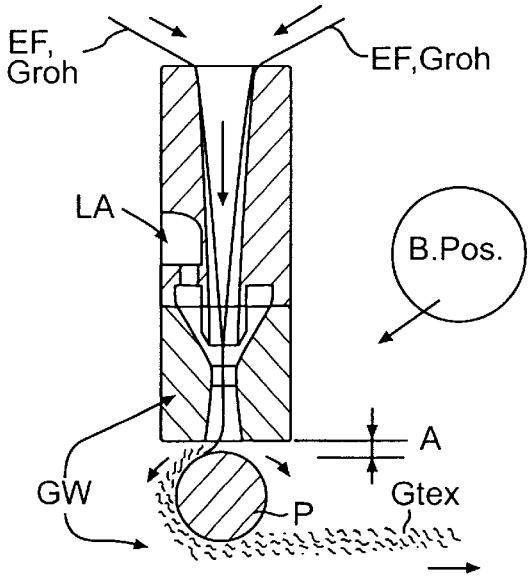
FIG. 2 PRIOR ART
FIG. 2 is a section through a texturing nozzle from the prior art with external texturing chamber.
Figure 2A:
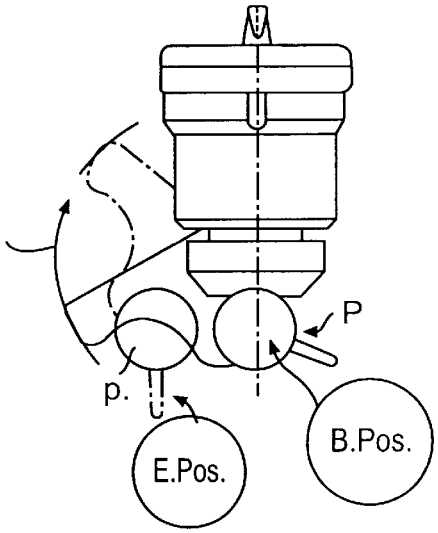
FIG. 2a PRIOR ART
Figure 2B:
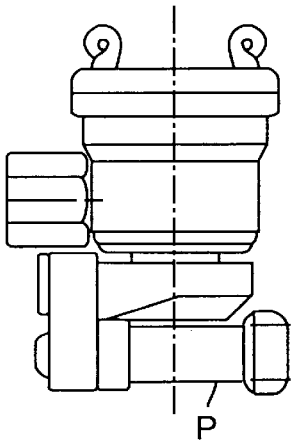
FIG. 2b PRIOR ART

FIGS. 2*a* and 2*b* are two views of concrete designs of texturing nozzle according to FIG. 2.

Figure 3:
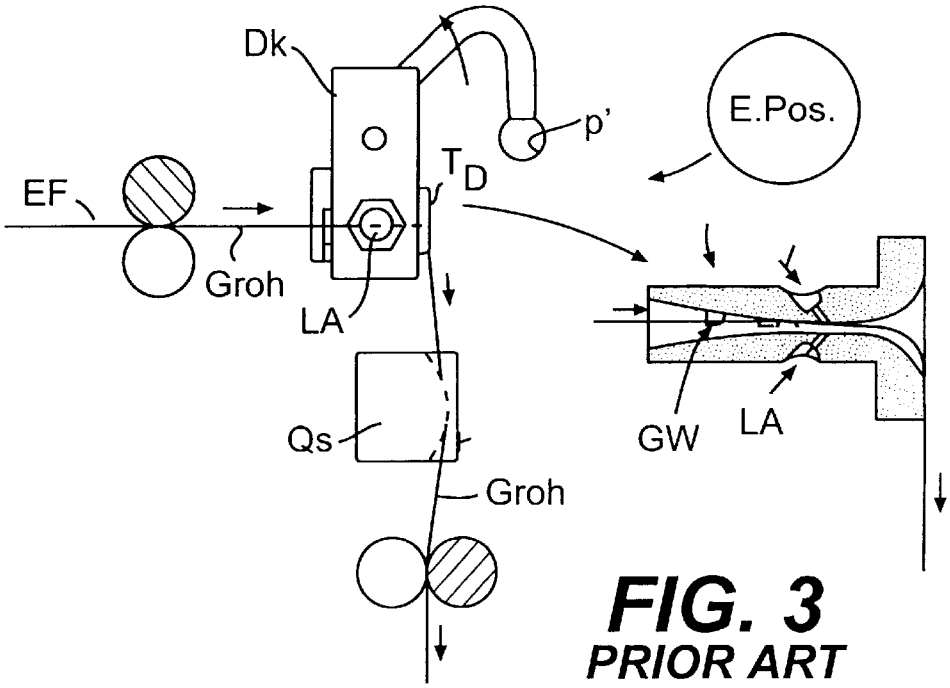
FIG. 3 PRIOR ART

FIG. 3 shows the threading position of a prior art texturing nozzle with internal texturing chamber.

Figure 3A:
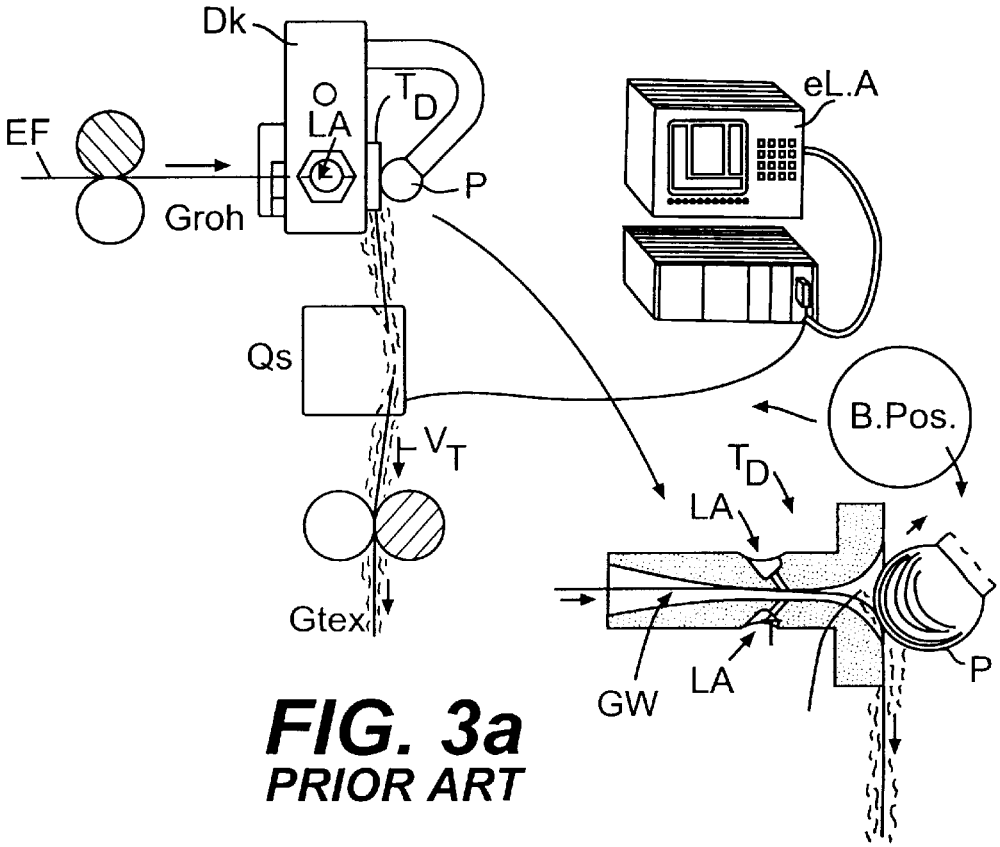
FIG. 3a PRIOR ART

FIG. 3*a* shows the operating position according to FIG. 3.

Figure 4:
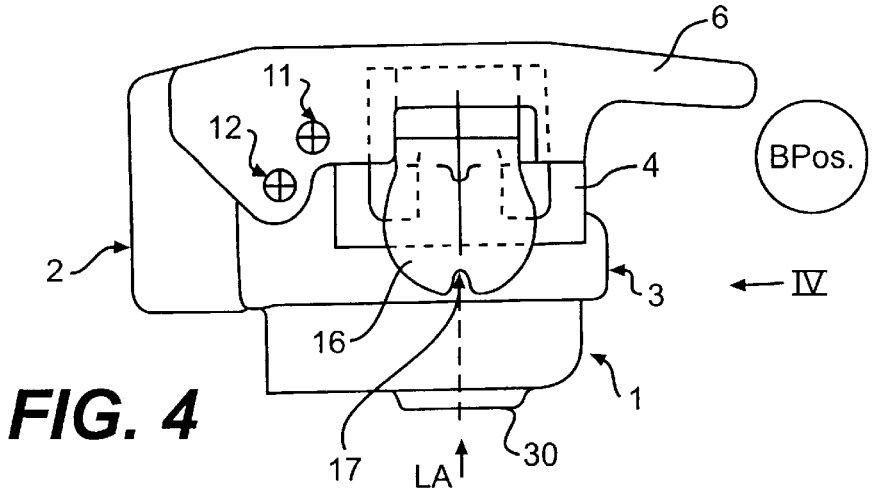
Figure 4A:
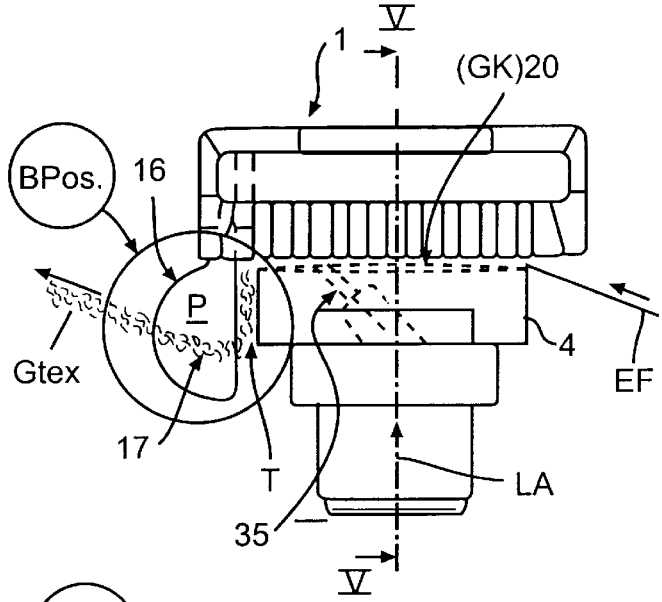
Figure 4B:
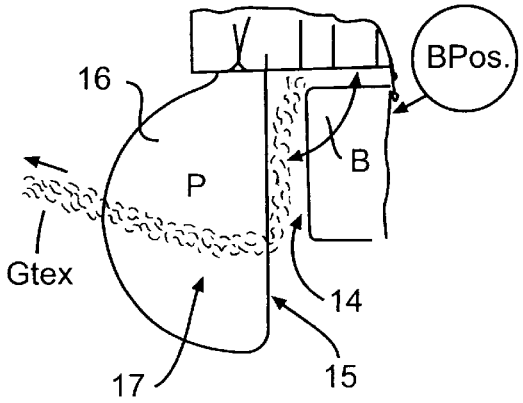

FIGS. 4 and 4*a* and 4*b* are views of a texturing nozzle according to the invention.

Figure 5:
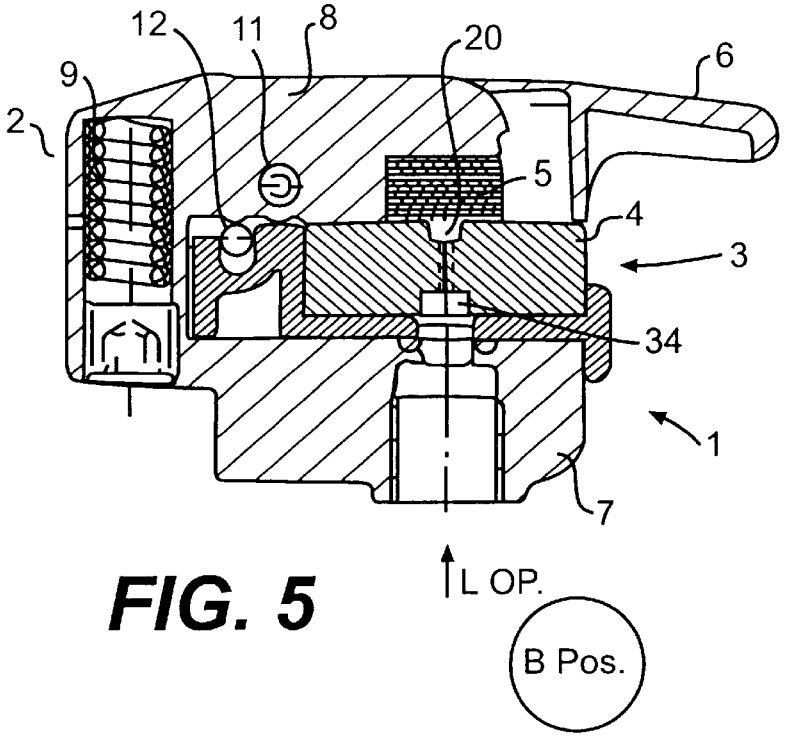

FIG. 5 is a section V—V from FIG. 4.

Figure 5A:
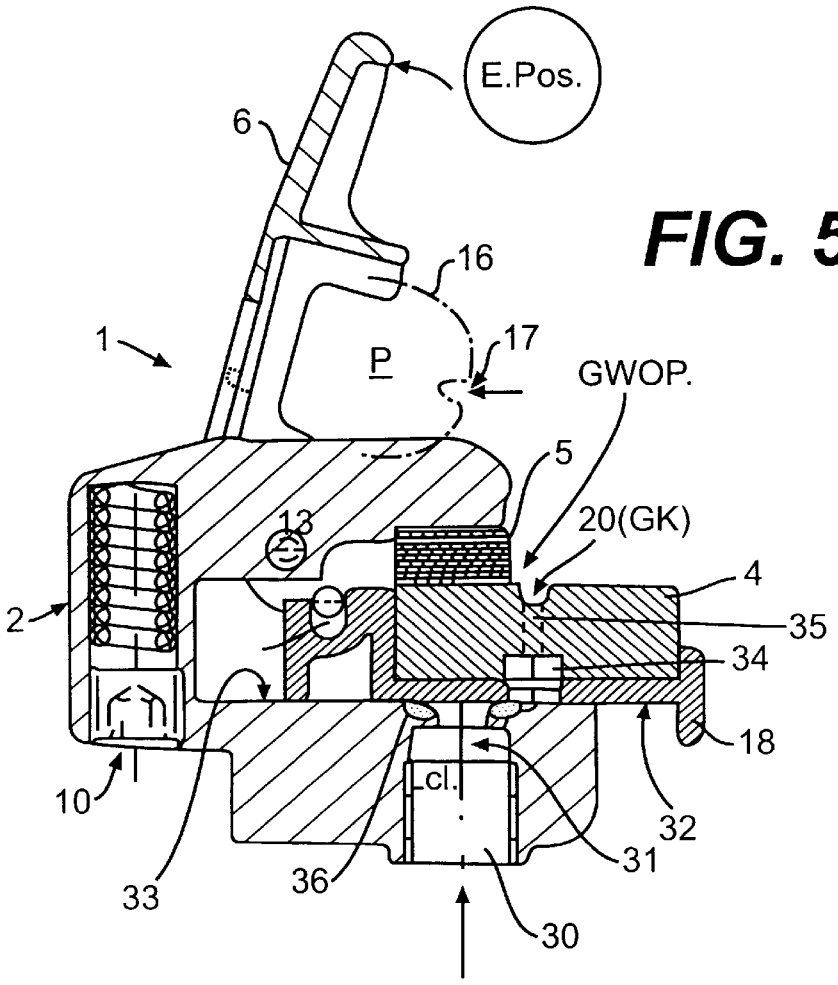

FIG. 5*a* shows FIG. 5 in the threading position.

Figure 6A:
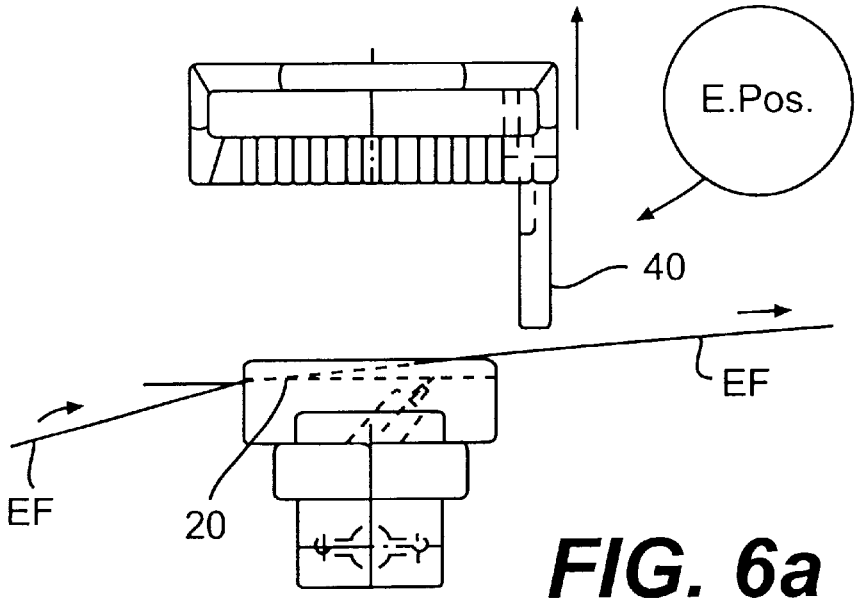
Figure 6:
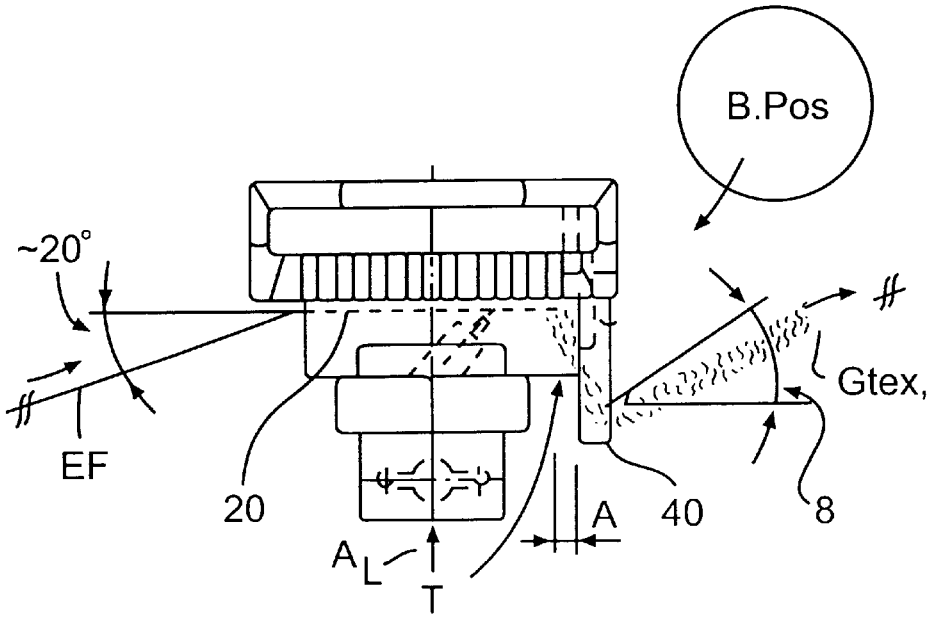

FIGS. 6 and 6*a* show a further embodiment of a texturing nozzle according to the invention, FIG 6*a* showing an open operating position and FIG. 6 a closed operating position.

Figure 7:
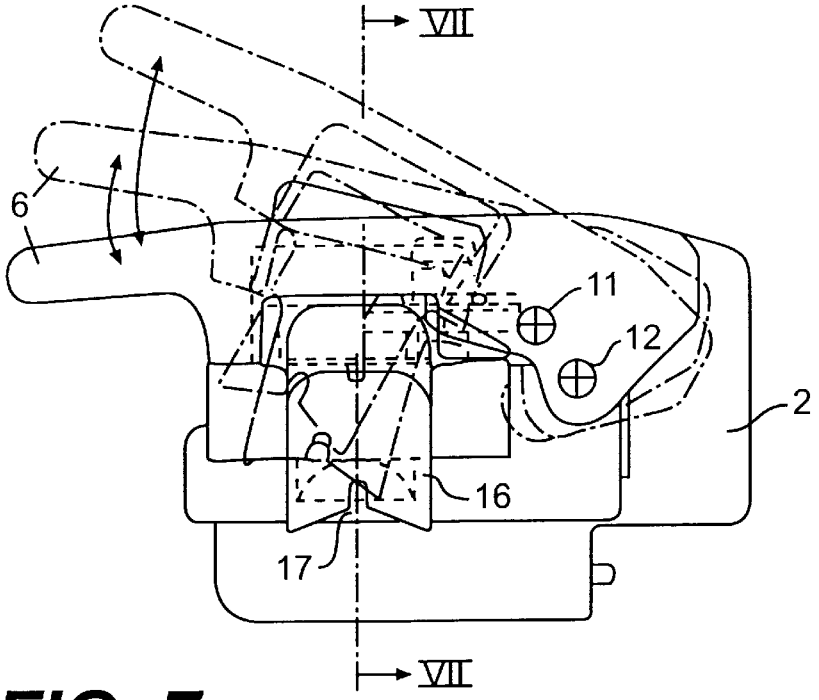

FIG. 7 shows the opening and closing movement in various positions.

Figure 7A:
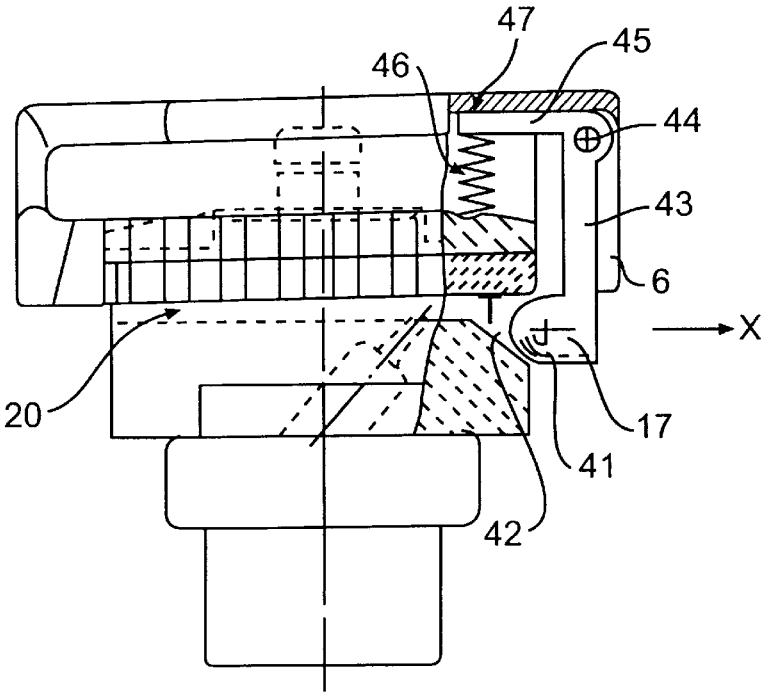

FIG. 7*a* shows a particular design of a deflecting member which penetrates into the yarn duct.

Figure 8:
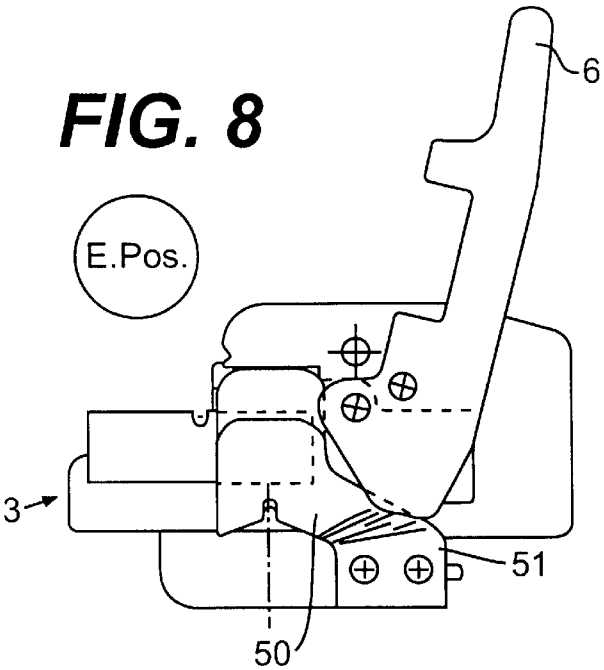
Figure 8A:
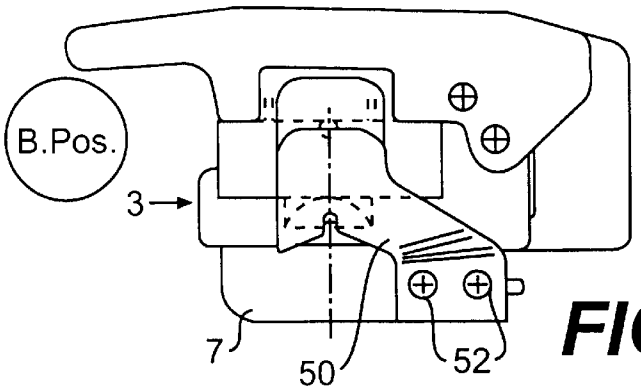

FIGS. 8 and 8*a* show a texturing nozzle with unmoving deflecting member.

Figure 9:
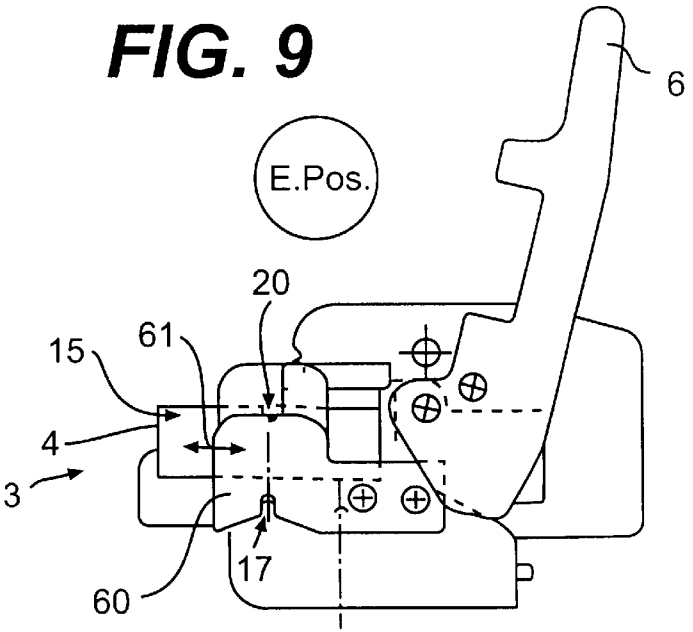
Figure 9A:
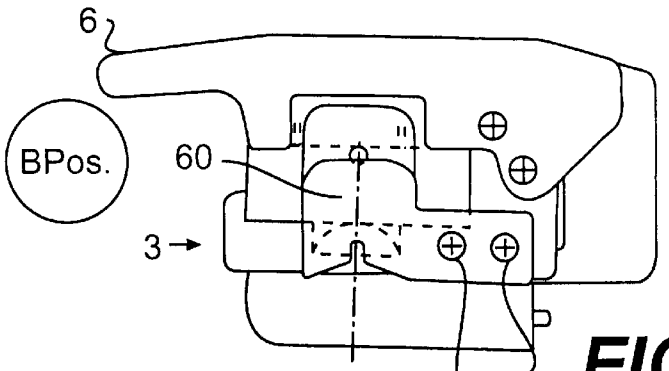

FIGS. 9 and 9*a* show a texturing nozzle with a deflecting member fastened on moving parts.

METHODS AND IMPLEMENTATION OF THE INVENTION

Reference will be made hereinafter to FIGS. 4 to 5 which show an entire texturing apparatus 1. The texturing apparatus 1 consists of a clamping frame 2, a moving nozzle member 3 with a nozzle plate 4, a gliding plate 5 and an articulated lever 6. The clamping frame 2 is composed of a rigid clamping base 7, a clamping bracket 8 and a clamping connection 10 which can be tensioned by a spring 9. The clamping connection 10 is activated when the nozzle member 3 with the nozzle plate 4 is to be installed or removed or the gliding plate is to be replaced. The articulated lever 6 is pivotal through about 90° round an axis of rotation 11 held in the clamping frame 2. On the articulated lever 6 there is arranged a sliding shaft 12 which engages in a recess 13 in the nozzle member 3 which is horizontally slidable in the drawing. As can be seen from FIGS. 5 and 5*a*, the opening movement of the articulated lever 6 forces a displacement of the nozzle plate 4 from the closed operating position (FIG. 5) into the cleared threading position (FIG. 5*a*). The entire yarn path can be seen best in FIG. 4*a* and consists of the yarn duct (GK) 20 and the texturing chamber T. The yarn duct 20 can be seen in FIGS. 4*a*, 5 and 5*a* as a U-shaped duct with a constant cross section over the entire yarn duct length.

The yarn duct 20 is worked completely in the nozzle plate 4 which is preferably produced from ceramic. In this embodiment, the gliding plate 5 consists of a plane plate without recesses for the yarn duct 20. The gliding plate 5 can be produced from a very resistant plastics material and in addition to the sealing function, should allow easy gliding for adjustment into the two illustrated positions. In the solution according to FIG. 4 and 4*a* the texturing chamber T is formed by one end face 14 of the nozzle plate 4 and a deflecting face 15 of a deflecting member 16 arranged substantially parallel thereto. The yarn path leads via the yarn duct 20 into the texturing chamber T and via a guide groove 17 in the deflecting member 16. The entire yarn path is now completely cleared when the articulated lever 6 is pivoted upwardly or outwardly and the nozzle plate 4 is displaced correspondingly outwardly and the deflecting member pivoted out of the yarn path (FIG. 5*a*). After insertion of the yarn, the articulated lever 6 is folded back into the closed position, the yarn EF automatically being placed in the passage position if the introduction into the guide groove is of a suitable design. The take-off direction of the textured yarn at an angle β of about 90° to the yarn duct 20 is very important in texturing. FIGS. 4*a*, 5 and 5*a* show a further interesting embodiment, illustrating the design of the compressed air supply means. Compressed air at, for example, 4 to 10 or more bars is connected via a compressed air connection 30 arranged in the rigid clamping base 7. The compressed air is guided via an aperture 31 with sealing ring 36 to a lower face 32 of the nozzle member 3. The nozzle member 3 has a nozzle plate holder 18 which glides in a planar manner on a gliding face 33 of the clamping base 7 with its lower face 32. The nozzle plate holder 18 is preferably also produced from a readily gliding plastics material so all gliding faces allow a good plane gliding connection without a gap between the two materials in addition to the air seal even after a prolonged operating period. The nozzle plate holder 18 and the nozzle plate 4 have a common aperture 34 which is arranged in such a way that, in the operating position (FIG. 5) the aperture 31 and the aperture 34 coincide and allow free passage for the compressed air. The relatively large cross section apertures 31 and 34 are guided through one or more fine air supply ducts 35 arranged at an angle, into the yarn duct 20. The present invention is not concerned with the size and arrangement of the air supply ducts 35. Reference is made to usual practice and, for example, to EP-PS No. 88 254.

With the illustrated design all three basic functions can be adjusted simultaneously and reliably via a single movable unit of which the central actuating element is the articulated lever 6. These are:

Clearing of the texturing chamber T (movement of the deflecting member 16);

Opening of the yarn duct 20 (retraction of the nozzle plate 4);

Actuation of the compressed air valve.

Various embodiments are illustrated in the following figures. FIG. 6 shows the operating position of an entire texturing apparatus and FIG. 6*a* the yarn guide in the open position.

The main difference from the solution in FIGS. 4 and 5 is that the deflecting member 40 is a simple flat plate which is held exchangeably in the articulated lever 6 at a defined distance A from the opposite end face of the nozzle plate. As in FIGS. 4 and 5, the deflecting member 40 has a deflecting or guide groove 17 so the solutions in FIGS. 4,5 and 6 are functionally identical with respect to the texturing process. In all solutions, the right-angled take-off of the textured yarn Gtex within the texturing chamber is very important. FIG. 6 and 6*a* show the intake of the continuous filament yarn EF within an angle of ~20° to the yarn duct 20. The take-off of the textured yarn G aster the deflecting member 40 is provided with parallel lines (//). This means that the textured yarn can travel in the same, possibly identical direction as during supply of the yarn. The great advantage of this embodiment is that the novel texturing apparatus can be installed in an existing machine without the need for additional yarn guides for changes of direction. On the other hand, all solutions also allow a different take-off direction as indicated by the angle δ. The angle δ can also be interpreted as a physical cone as, within a great range, the direction of travel of the yarn after the deflection does not affect the function in the texturing chamber T.

FIG. 7 shows various positions of the articulated lever 6, whether for the opening or closing path, the deflecting member being fastened in the articulated lever 6 as in FIGS. 6 and 6*a*.

FIG. 7*a* shows a further very interesting embodiment with an internal texturing chamber T. The deflecting member 41 penetrates into a widening 42 at the end of the yarn duct 20. The deflecting member 41 is articulated to the articulated lever 6 via an arm 43 and a swivel pin 44. The deflecting member 41 is pressed into the working position by a compression spring 46 via an arm extension 45. To enable the working position to be adopted again after each change with relatively great accuracy, the compression spring 46 presses the arm extension onto a stop 47 provided on the articulated lever 6. A deflecting or guide groove 17 which could also be designed as a guide bracket here is preferably also provided on the deflecting member 41.

FIGS. 8, 8*a* and 9 and 9*a* show different fastening means for the respective deflecting member which, as in the other embodiments, is also designed as a deflecting guide member here. FIG. 8 shows an entire apparatus in the open or threading position and FIG. 6*a* in the closed or operating position. The deflecting member 50 is fixed via a holding bracket 51 directly on the clamping base 7 via barriers 52. The deflecting member 50 is therefore part of the unmovable elements of the apparatus. However, as the nozzle member 3 travels out for the threading position, the entire yarn path is also completely cleared here for threading. It is immediately possible to design the deflecting member 50 substantially according to FIG. 7*a*, but with a movement only in the direction of the axis "X", i.e. for an internal texturing chamber.

FIGS. 9 and 9*a* show a further embodiment. In this case, the deflecting member 60 is fastened directly on the moving nozzle member 3. When the threading position is open, therefore, the distance A of the texturing chamber (according to FIG. 6) is unchanged. It is important for the texturing chamber to be free or open forwardly, according to the arrow 61 here. For threading purposes, the yarn according to FIG. 9 is inserted into the yarn duct 20 and placed over the end face 15 of the nozzle plate 4 into the guide groove 17.

It has been found that the new solution allows a number of particular advantages. The apparatus can also be fitted in a straight yarn path at a later stage without the need for additional yarn guides. The solution allows simple parallel travel and moistening is not necessary in many cases. It is also even possible to modify the apparatus for interlacing by removing the deflecting member and exchange of the texturing insert for an interlacing insert optionally with additional yarn guides. The new invention is particularly advantageous as preliminary air texturing in false twist texturing machines.

I claim:

1. A process for operating an apparatus for the texturing of at least one filament of yarn, the apparatus including a yarn duct having an axis and a compressed air supply, a texturizing chamber, and a deflecting member proximate the texturizing chamber, the yarn being taken off from the texturizing chamber transversely to the duct axis, whereby the yarn duct and the deflecting member together form a yarn path and define a direction of travel of the yarn from a yarn supply side of the yarn duct to a side of the yarn duct at which the yarn is transversely taken off, the process including the steps of a) providing a slide plate defining a part of the duct, the slide plate being displaceable along a path transverse to the duct axis;

b) displacing the slide plate in a first direction for clearing the yarn path including a take-off portion proximate the texturizing chamber, said displacing in the first direction resulting in a threading position;

c) threading the filament of yarn through the duct and the texturizing chamber including along the cleared take-off path portion;

d) displacing the slide plate in a second direction substantially opposite to the first direction for enclosing the filament of yarn in the yarn path including the take-off path portion, said displacing in the second direction resulting in an operating position; and e) texturing the filament of yarn, wherein in the first direction displacing step, the entire yarn path is cleared in the region of the yarn duct and the texturizing chamber for threading and in the second direction displacing step, the entire yarn path is enclosed in the region of the yarn duct and texturizing chamber for texturing.

2. A process according to claim 1, further including a step of deflecting the yarn immediately after the yarn is transversely taken off from the texturizing chamber such that the yarn again travels in the direction of travel of the yarn from the yarn supply to the yarn duct.

3. A process according to claim 1, wherein the deflecting member is adapted to guide the textured yarn to return back to a direction of supply of the yarn to the yarn duct.

4. A process according to claim 1, wherein the compressed air supply is mechanically coupled with the slideplate such that the displacing directions of the slide plate respectively open the air supply in the operating position and block the air supply in the threading position.

5. An apparatus for the texturing of at least one filament of yarn along a yarn path, the apparatus comprising a yarn duct with a compressed air supply, a texturizing chamber, and a deflecting member disposed at an outlet of the texturizing chamber and defining a yarn take-off path portion proximate the texturizing chamber outlet substantially at right angles to the yarn duct and wherein a first path-defining element of the yarn duct includes a slide plate displaceable relative to a second path-defining element of the yarn duct in a first direction transverse to the duct to an open threading position and in a second direction substantially opposite said first direction to an operating position, wherein said deflecting member is coupled to said slide plate such that the yarn take-off path portion is cleared at the threading position and is enclosed at the operating position.

6. An apparatus according to claim 5, wherein the slideplate and the deflecting member are configured to rapidly clear and close the entire yarn path, the deflecting member being configured to move such that a region of the texturizing chamber is also cleared for threading in the threading position.

7. An apparatus according to claim 5, wherein the slideplate is moveably disposed relative to the compressed air supply such that the slideplate blocks the air supply in the threading position and opens the air supply in the operating position.

8. An apparatus according to claim 5, wherein the slideplate is displaceable into the respective operating and threading positions via a tilting articulated lever.

9. An apparatus according to claim 5, wherein the yarn duct is disposed completely in a moving nozzle plate which is displaceable relative to a plane gliding plate which encloses the yarn duct over the entire length in the operating position, the yarn duct having a substantially constant or widened cross section.

10. An apparatus according to claim 9, wherein the moving nozzle plate includes a compressed air supply passage with at least one aperture opening at an angle into the yarn duct.

11. An apparatus according to claim 5, wherein the deflecting member is connected to movable elements of the yarn duct and, in the threading position, exposes or vacates the yarn path.

12. An apparatus according to claim 5, wherein the slide plate and the deflecting member are configured to move simultaneously via a common articulated lever, the deflecting member being rigidly connected to the articulated lever and being pivotal transversely to the yarn duct.

13. An apparatus according to claim 5, wherein a gliding plate for closing the yarn duct, the deflecting member, and a shut-off valve are configured to move simultaneously for the simultaneous rapid clearing of the entire yarn path and for one of the blocking and opening of the air supply.

14. An apparatus according to claim 5, wherein the nozzle plate is pivotably disposed on an articulated lever and the deflecting member is also coupled to the articulated lever so that the deflecting member is tiltably movable into one of the operating and threading positions, the air being respectively shut off or cleared in a coordinated manner with the movement of the nozzle plate.

15. An apparatus according to claim 5, wherein the yarn duct outlet includes a widened portion in the form of a funnel or trumpet, and the deflecting member penetrates the widened portion in the operating position, the deflecting member additionally being movable away from the outlet in the direction of the yarn duct axis.

16. An apparatus according to claim 5, wherein the deflecting member is coupled to stationary parts of the apparatus in such a way that the yarn path of the texturizing chamber is cleared for threading in the threading position.

17. An apparatus according to claim 5, wherein the deflecting member has a deflecting face for taking off the textured yarn substantially at right angles and then, in the direction of travel of the yarn, a deflecting or guide groove for ensuring the take-off direction for texturing, regardless of the subsequent direction of travel of the yarn, the texturizing chamber being open at least on two sides for clearing the yarn path and for taking off the yarn substantially at right angles from the yarn duct.

* * * * *